US006565405B2

(12) United States Patent
Hsu et al.

(10) Patent No.: US 6,565,405 B2
(45) Date of Patent: May 20, 2003

(54) INTERCONNECTING INFLATABLE PLAY STRUCTURE

(75) Inventors: Yaw-Yuan Hsu, Taipei (TW); Chin-Hsiang Pan, Taipei Hsien (TW); Kun Chao Hsu, Taipei (TW)

(73) Assignee: Intex Recreation Corp., Long Beach, CA (US)

( * ) Notice: Subject to any disclaimer, the term of this patent is extended or adjusted under 35 U.S.C. 154(b) by 0 days.

(21) Appl. No.: 10/173,348

(22) Filed: Jun. 17, 2002

(65) Prior Publication Data

US 2003/0003840 A1 Jan. 2, 2003

Related U.S. Application Data

(63) Continuation-in-part of application No. 09/479,804, filed on Jan. 8, 2000, now abandoned.

(51) Int. Cl.[7] ..... E04B 1/34; A63H 33/08

(52) U.S. Cl. ..... 446/89; 446/220; 446/478; 472/136; 52/2.18

(58) Field of Search ..... 52/2.11, 2.17, 52/2.18, 2.22; 446/85, 89, 220, 221, 476, 478; 135/87; 472/136

(56) References Cited

U.S. PATENT DOCUMENTS

| | | | | | |
|---|---|---|---|---|---|
| 4,267,662 | A | * | 5/1981 | Gordy | 446/89 |
| 5,169,353 | A | * | 12/1992 | Myers | 446/221 |
| 5,305,561 | A | * | 4/1994 | Goddard | 52/2.22 |
| 5,678,357 | A | * | 10/1997 | Rubio et al. | 52/2.17 |
| 5,761,852 | A | * | 6/1998 | Liu | 52/2.18 |
| 5,819,479 | A | * | 10/1998 | Rodriguez-Ferre | 52/79.4 |
| 5,893,238 | A | * | 4/1999 | Peacock et al. | 52/2.18 |

* cited by examiner

*Primary Examiner*—Jacob K. Ackun
(74) *Attorney, Agent, or Firm*—Lewis, Brisbois, Bisgaard & Smith LLP

(57) ABSTRACT

An inflatable play structure comprises at least one inflatable house defining a cavity for accommodating a child and an inflatable tunnel detachably attached to the house. The house includes two side walls and front and rear walls connected together to form a continuous wall, and support tubes placed at each corner of the two side walls and front and rear walls. The house has a first access opening and a first one flap extending from a lower portion of the wall having a pair of hook and loop fasteners. The inflatable tunnel has two arched tubes erected from and affixed to a bottom wall defining a first opening and a second opening. The tunnel includes at least one open window and a second flap extending along the bottom wall and having a pair of hook and loop fasteners aligned with corresponding hook and loop fasteners of the house.

24 Claims, 5 Drawing Sheets

INTERCONNECTING INFLATABLE PLAY STRUCTURE

This application is a Continuation-in-part application of the application having Ser. No. 09/479,804 filed on Jan. 8, 2000 entitled Interconnecting Inflatable Play Structure by inventors Yaw-Yuan Hsu, Chin-Hsiang Pan and Kun Chao Hsu now abandoned.

BACKGROUND OF THE INVENTION

1. Field of the Invention

The present invention relates to inflatable play structures, and more particularly, to children's play structures, such as inflatable houses and tunnels, which are easily attachable to and removable from each other by using hook and loop fasteners.

2. Discussion of the Related Art

Children enjoy playing in inflatable toy structures. Conventional inflatable toy structures are individually free standing without being able to interconnect between them. Many types of toys have been devised to help develop children's body spatial relationships. As an example, rigid tubes positioned together, end to end with a wood base, to prevent rolling, are presently in use. Other such tunnels, using helical spring steel hoops covered with a cloth or plastic material are commonly in use and are known in the industry.

In child growth, the use of devices that help development of body control in motion, such as creeping and crawling, are becoming more prevalent. Presently, rigid structural tubes, or pipes, are in use both indoors and out. Flexible collapsing tunnels are especially popular for indoor use, however, these devices, as well as the outdoor equipment with a hard bottom surface, have a tendency to scuff the children's legs and clothing and are uncomfortable when in use.

Children are typically fond of tunnel like structures, such as large boxes, in which they may play. This preference is embodied in many playgrounds and parks and indoor toys where enclosed slides and tire tunnels are commonly constructed for the children's enjoyment. Recognizing the play value of tunnels, several toy tunnel structures have been developed in the prior art and marketed to children. As is typical with such prior art toy tunnels, the tunnel structure only has openings at its two ends. Accordingly, using a single tunnel structure, children can only enter into one opening and exit at the other opening. As a result, the amusement value of the tunnel quickly wanes as the children become familiar with the tunnel structure. The continuous structure of the toy tunnel and other structure also makes it very difficult to assemble the play structures in a confined area or indoors.

A play structure with much more entertainment value is one that allows a child to enter and exit at multiple points. As a result, more than one child can play with the play structure at once, meeting at various points without concern of one child blocking another's passage. Play structures with multiple entrances and exits have been limited mostly to playhouse structures and tents. However, these devices are not easily connected to each other.

Therefore, there is a need in the art for an interconnecting inflatable play structure that is easily attachable to and removable from other play structures to provide entrances at multiple points. Accordingly, several structures can be joined together in hundreds of differing configurations.

SUMMARY OF THE INVENTION

Accordingly, the present invention is directed to an interconnecting inflatable play structure that substantially obviates one or more of the problems due to limitations and disadvantages of the related art.

An object of the invention provides a multitude of combined shapes and matrixes when houses and tunnels are joined together. A number of tunnels and houses may be attached in tandem with one end of the assembly connected to a multiple opening intersection. Also, others may be attached projecting at various angles therefrom. This flexible arrangement allows the children to use their imagination and creativity in organizing the desired shape or form.

Another object of the invention provides collapsible and deflatable play structures, thereby allowing the house and tunnel structures to be easily stored when not in use.

Still another object allows construction with cost effective material, such as polyvinyl chloride sheeting, or any other substance having characteristics suitable for inflating, including thermoplastic impregnated cloth, and the like.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an inflatable play structure for use by a child comprises an inflatable first structure defining a cavity sufficiently large to accommodate the child, the first structure having at least one side wall defining a first opening, the side wall of the first structure having at least one flap extending from a lower portion of the side wall, wherein the flap has at least one hook and loop fastener thereon; and an inflatable second structure having at least one flap extending therefrom, the flap having at least one hook and loop fastener thereon which is aligned with the hook and loop fastener of the first flap to releasably couple the first and second structures to allow the child to move from the first structure to the second structure. Preferably, the first and second structures are comprised of polyvinylchloride sheeting.

According to one aspect of the preferred embodiment, the first structure is an inflatable house, and the second structure is an inflatable tunnel. The house includes two side walls and front and rear walls which are connected together to form a continuous wall and support tubes placed at each corner of the two side walls and front and rear walls. The side wall of the house defining the first opening has the flap extending therefrom. The flap includes a pair of hook and loop fasteners aligned with corresponding hook and loop fasteners of the second structure.

The tunnel includes at least two arched tubes erected from and affixed to a bottom wall, a first arched tube defining a first opening and a second arched tube defining a second opening. The tunnel also includes the flap extending from and substantially along the width of the bottom wall. The flap of the tunnel includes a pair of hook and loop fasteners aligned with corresponding hook and loop fasteners of the first structure.

According to another embodiment of the present invention, an inflatable play structure comprises an inflatable first structure defining a cavity sufficiently large to accommodate the child, the first structure having at least one side wall defining a first opening; an inflatable second structure defining a cavity sufficiently large to accommodate the child; and a connecting means on exposed outside surfaces of the first and second structures for releasably attaching the first and second structures, wherein the connecting means is attached to uninflated portion of the first and second structures. Preferably, the connecting means includes at least one first flap extending from a lower portion of the side wall of the first structure, wherein the first flap has at least one hook and loop fastener thereon and at least one second flap extending from the second structure, the second flap having at least one hook and loop fastener thereon which is aligned with the hook and loop fastener of the first flap to releasably couple the first and second structures to allow the child to move from the first structure to the second structure.

According to another embodiment of the present invention, the play structure comprises an inflatable house defining a cavity sufficiently large to accommodate the child, the house including two side walls and front and rear walls which are connected together to form a continuous wall and support tubes placed at each corner of the two side walls and front and rear walls, one of the walls having a first opening and a plurality of hook and loop fasteners at lower end of the first opening; and an inflatable tunnel having at least two arched tubes erected from and affixed to a bottom wall, a first arched tube defining a first opening and a second arched tube defining a second opening, wherein one end of the bottom wall has a plurality of hook and loop fasteners aligned with corresponding hook and loop fasteners of the house to releasably couple the house and the tunnel, wherein the house and the tunnel are comprised of polyvinylchloride sheeting.

It is to be understood that both the foregoing general description and the following detailed description are exemplary and explanatory and are intended to provide a further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF THE PREFERRED EMBODIMENTS

With reference to the drawings, and in particular to FIGS. 1–8 thereof, an interconnecting inflatable play structure embodying the principles and concepts of the present invention will be described.

Figure 1:
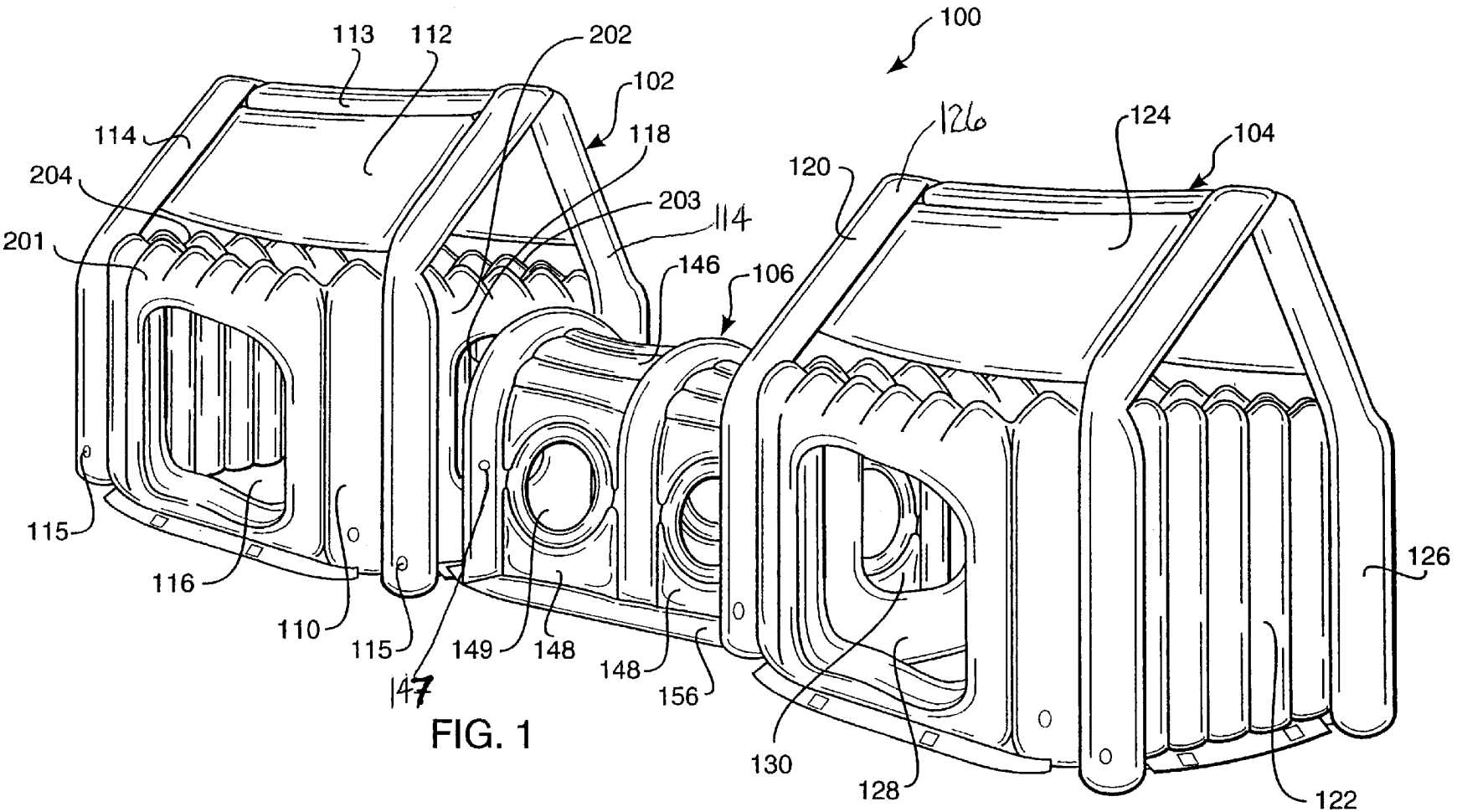
FIG. 1 illustrates a perspective view of a preferred embodiment of an interconnecting inflatable play structure.
Figure 2:
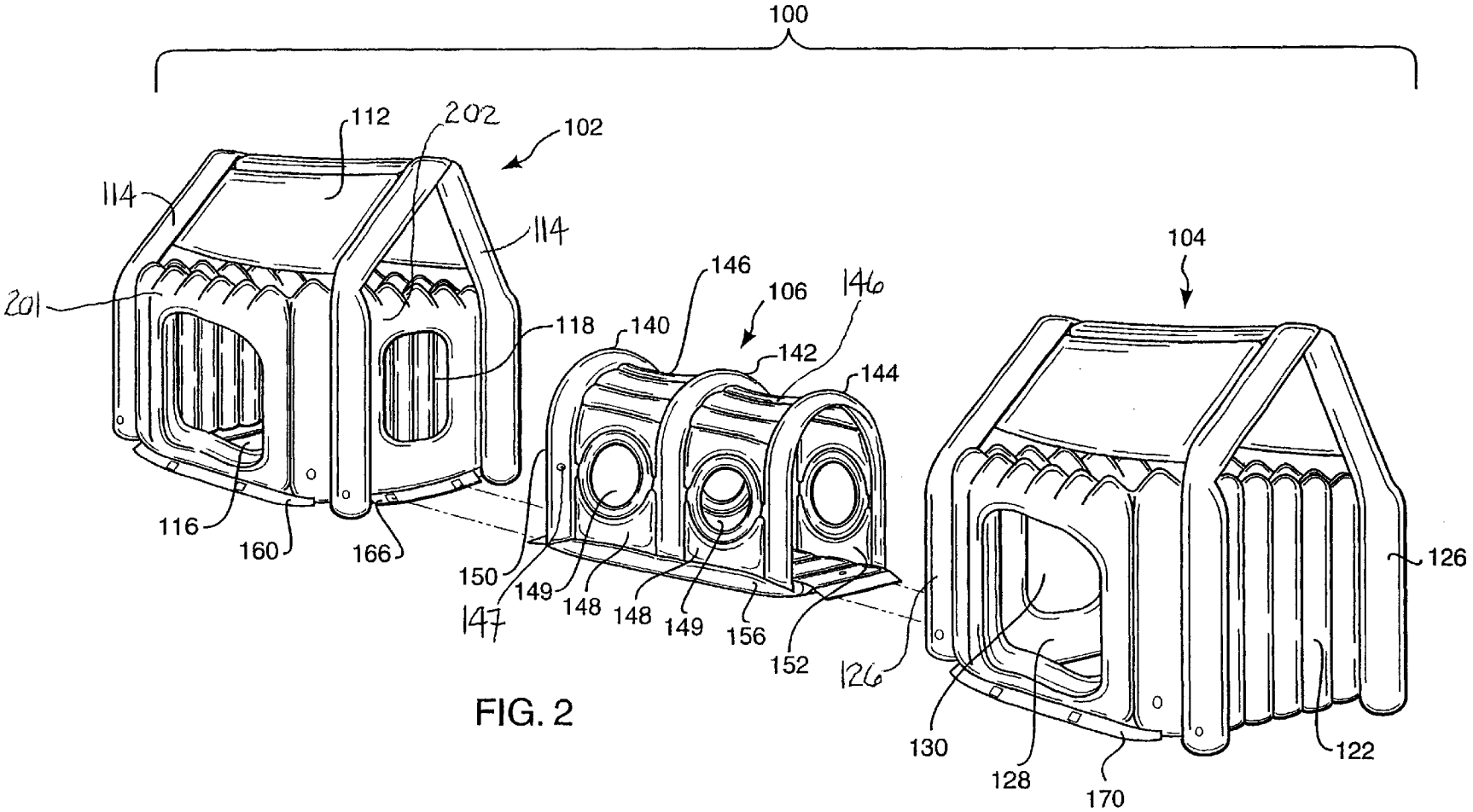
FIG. 2 illustrates a detached view of FIG. 1 showing a tunnel placed between and connecting two inflatable play houses according to the preferred embodiment of the present invention.

FIG. 1 illustrates a perspective view of a preferred embodiment of an interconnecting inflatable play structure 100. FIG. 2 illustrates a detached view of FIG. 1 showing a tunnel 106 placed between and connecting two inflatable playhouses 102, 104 according to the preferred embodiment of the present invention. The present invention is directed to an interconnecting inflatable play structure 100 typically used by children in-doors or out-of-doors. The interconnecting inflatable play structure 100 includes a plurality of play structures which are easily interconnected to allow children to move between or among various play structures, such as houses and tunnels. According to the preferred embodiment, the interconnecting inflatable play structure 100 includes a first inflatable house 102 connected to a second inflatable house 104 through an inflatable tunnel 106. The use of the first and second inflatable houses 102, 104 and the inflatable tunnel 106 are for illustration purposes only and should not limit the scope of the present invention. The present invention may be used with any number of inflatable houses with or without tunnels.

In the preferred embodiment, a continuous side wall 110 includes a plurality of polygon shaped, preferably rectangular, walls. In particular, the side wall 110 comprises an inflatable first side wall 201 having an access opening 116, front wall 202 having an access opening 118, second sidewall 203 and rear wall 204 both of which do not have any openings. The child access openings 116 and 118 are sufficiently large to allow children to enter or exit the inflatable house 102. It is noted that the access openings 116 and 118 are continuously open to the atmosphere, i.e., air freely flows through the entire interconnecting inflatable play structure 100. This construction facilitates the ability of children to enter and exit the interconnecting inflatable play structure 100 which is not sealed off, isolated, or air tight in any manner.

The first side wall 201 has an appearance of a corrugated surface to simulate the shape of a plurality of vertical tubes fused or connected side by side. The first side wall 201 preferably has one air pocket or chamber which defines the rectangular access opening 116 once inflated with pressurized air. The same is also true for the front wall 202. The second side wall 203 and the rear wall 204 each includes a plurality of vertical tubes which are in fluid communication with respect to each other. The side edges of the walls 201, 202, 203 and 204 are fused together in tandem to form the continuous side wall 110 using the process of radio frequency sealing or other processes known to those having ordinary skill in the art. In the preferred embodiment, each one of the walls 201, 202, 203 and 204 is individually equipped with an inflation air valve 115 to insert and discharge pressurized air. The material utilized for the first house 102 is comprised of a flexible inflatable material, such as polyvinylchloride sheeting (typically referred to as PVC), thermoplastic impregnated cloth, or other materials known to those having ordinary skill in the art.

The first inflatable house 102 also includes two arched inflatable support tubes 114 preferably placed at the four corners of the side wall 110. The support tubes 114 extend over the height of the side wall 110 to form the facades of the house. Each support tube 114 is equipped with one of the inflation air valves 115 for the insertion and discharge of pressurized air. The two arched inflatable support tubes 114 are preferably made with PVC or other suitable materials.

Placed between the two support tubes 114 is a ceiling tube 113 which defines the top of the first inflatable house 102. The ceiling tube 113 has an independent air chamber. Two ends of the ceiling tube 113 are fused between the two support tubes 114 using a suitable process, such as radio frequency sealing or another process known to those of ordinary skill in the art. The air chamber of the ceiling tube 113 is also equipped with an inflation air valve 115 for the insertion and discharge of pressurized air. The ceiling tube 113 is also preferably made with PVC or other suitable materials.

As shown in FIGS. 1 and 2, the first inflatable house 102 has a roof sheet 112 supported by and attached to the ceiling tube 113 and the two arched inflatable support tubes 114. In particular, the middle of the roof sheet 112 is supported by and attached to the ceiling tube 113. The side edges of the roof sheet 112 are fused to the upper portion of the support tubes 114 to form a roof of the first inflatable house 102. The roof sheet 112 is preferably made with a PVC sheet or fabric for easy folding and flexibility.

As shown in FIG. 2, the first inflatable house 102 has a plurality of flaps 160, 166 extending from the lower end portion of the side walls having child access openings 116, 118. In particular, the first inflatable house 102 has a side flap 160 and a front flap 166 extending from the lower end portion of the side wall 201 and the front wall 202, respectively. Each flap 160, 166 includes a pair of hook and loop fasteners securely affixed thereto for easy connection with another toy play structure also equipped with hook and loop fasteners. The side flap 160 and the front flap 166 are each made of at least one layer of PVC sheets which are used for constructing the side and bottom walls. Because the flaps 160, 166 are not inflated, the hook and loop fasteners can be stitched directly onto each respective flap. In addition, other suitable attachment methods may also be utilized, such as employing adhesives, etc. Preferably, the side and front flaps 160, 166 extend along the length of their respective sides between four vertical posts formed by two arched supports 114. The details of the flap 160, 166 and the hook and look fasteners are described in FIGS. 6 and 7.

Referring to FIGS. 1 and 2 and similarly to the first inflatable house 102, the second inflatable house 104 includes a continuous side wall 122 fused at four corners to a pair of arched support tubes 126. The components and the structure of the second inflatable house 104 are identical to that of the first inflatable house 102 and therefore the description with regard to such components will not be repeated here.

Figure 5:
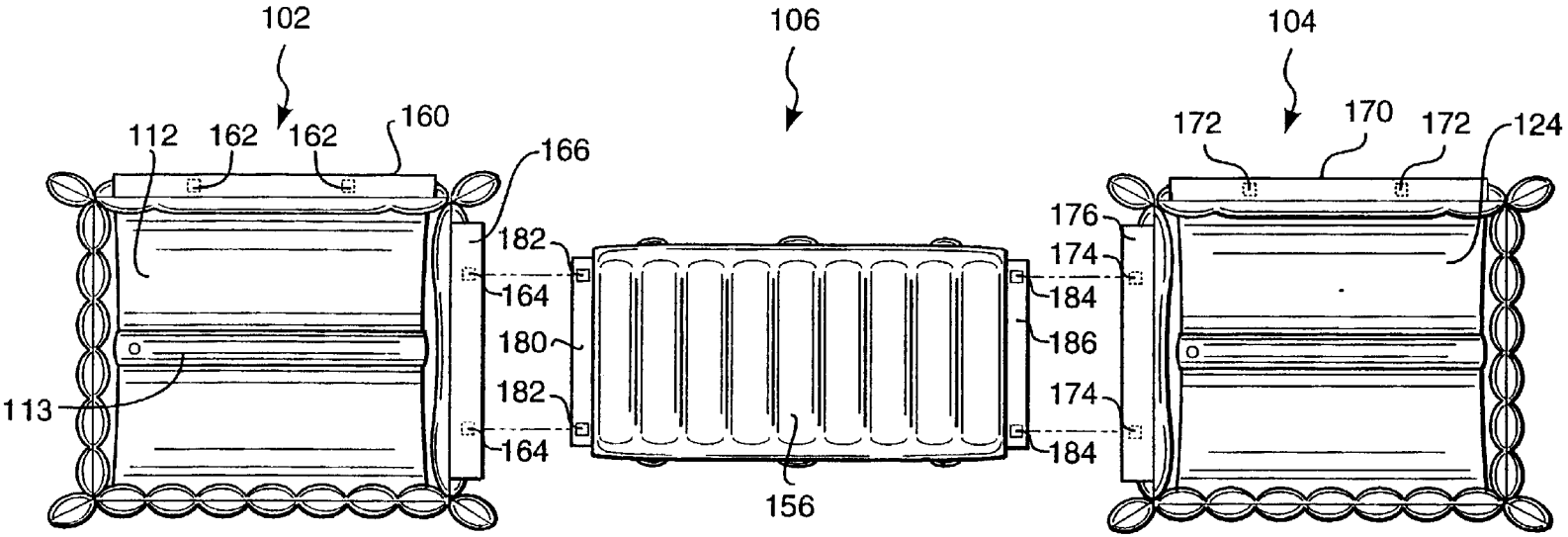
FIG. 5 illustrates a bottom planar view of the interconnecting inflatable play structure of FIG. 2.

As shown in FIG. 2, the second inflatable house 104 also has a plurality of flaps 170 and 176 extending from the lower end portion of the continuous side wall 122 having child access openings 128, 130. The access openings 128 and 130 are sufficiently large to allow children to enter or exit the inflatable house 104. It is noted that the access openings 128 and 130 are continuously open to the atmosphere, i.e., air freely flows through the entire interconnecting inflatable play structure 100. This construction facilitates the ability of children to enter and exit the interconnecting inflatable play structure 100 which is not sealed off, isolated, or air tight in any manner. The second inflatable house 104 includes a side flap 170 and a front flap 176 extending from the bottom edge of the side wall and the front wall, respectively as is best shown in FIG. 5. Each flap includes a pair of hook and loop fasteners 172, 174 securely affixed thereto for each connection with another toy play structure or one or more tunnels 106.

According to the preferred embodiment, one or more inflatable tunnels 106 may be used with inflatable houses 102, 104 to provide access to one or more inflatable houses interconnected with the tunnels. The inflatable tunnel 106 is placed, for example, between the first and second inflatable houses 102 and 104 to connect the front access opening 118 of the first inflatable house 102 and the front access opening 130 of the second inflatable house 104.

The inflatable tunnel 106 includes three arched tubes 140, 142 and 144 which are serially placed, with the two opposite tubes 140, 144 placed at an equal distance from the middle tube 142 as is best shown in FIG. 2. Connected between the arched tubes 140, 142 and 144 are inflatable tubes 146 that are either fully or partially covering the roof portion of the tunnel 106. Also placed between the arched tubes 140, 142 and 144 are inflatable side walls 148 having a plurality of open windows 149 formed therein to allow viewing of the tunnel's interior. It is noted that the plurality of open windows 149 formed within the inflatable side walls 148 of the inflatable tunnel 106 are continuously open to the atmosphere, i.e., air freely flows through the entire interconnecting inflatable play structure 100. This construction facilitates the ability of children to see into the interior of the tunnel 106 from outside the tunnel, and to see exterior of the tunnel 106 from inside the tunnel. The interconnecting inflatable play structure 100 is not sealed off, isolated, or air tight in any manner.

The side walls 148 and the inflatable tubes 146 are preferably in fluid communication with each other so that one air valve 147 can be used to input pressurized air into the inflatable tunnel 106. The inflatable tubes 146 and the side walls 148 of the inflatable tunnel 106 are made of PVC or other suitable material known to those of ordinary skill in the art. The inflatable tubes 146 are fused together with the side walls 148 by such method as radio frequency sealing or by using adhesives or other methods known to those of ordinary skill in the art.

Figure 3:
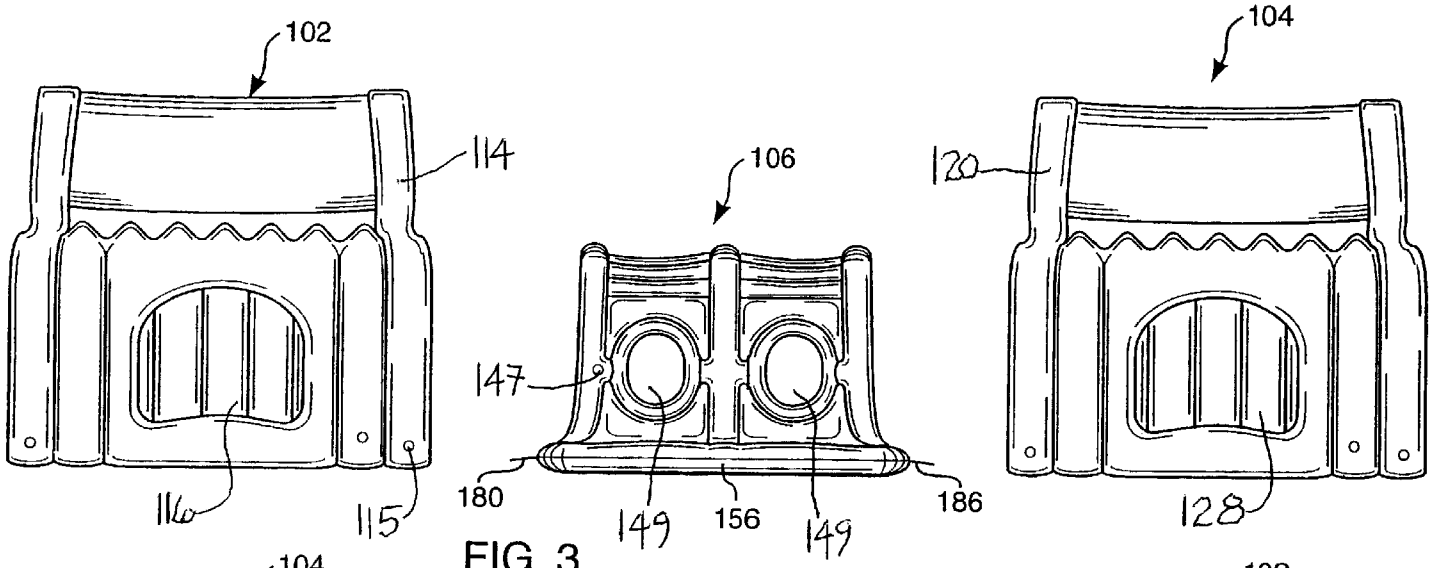
FIG. 3 illustrates a left elevational view of the interconnecting inflatable play structure of FIG. 2.
Figure 4:
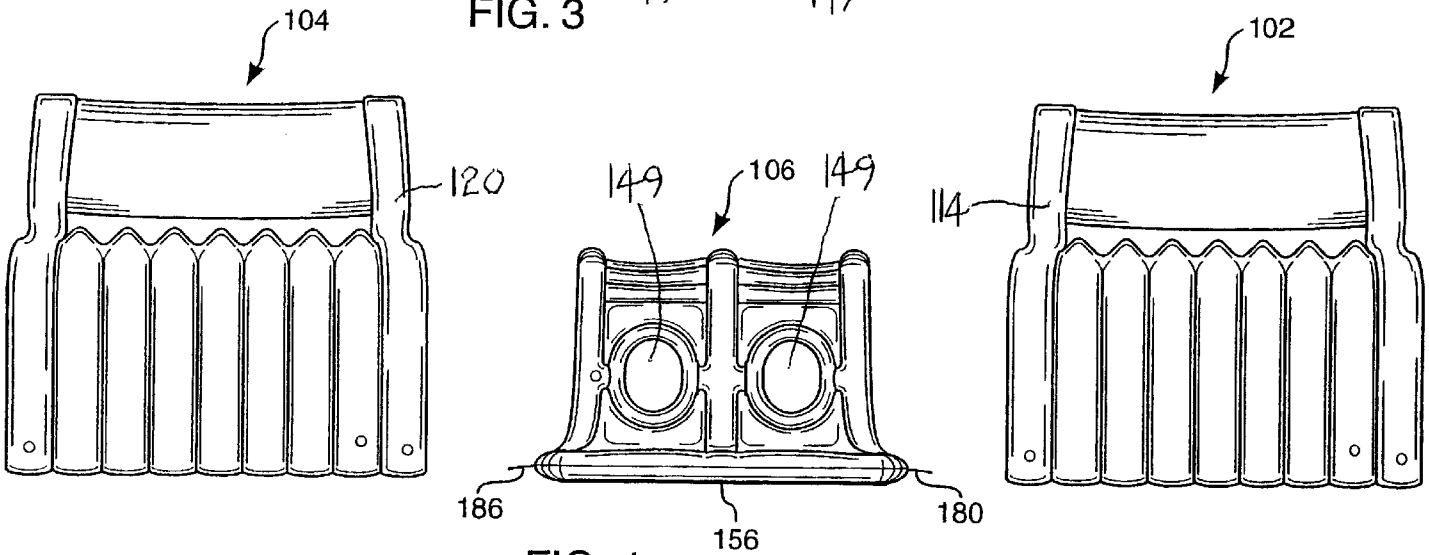
FIG. 4 illustrates a right elevational view of the interconnecting inflatable play structure of FIG. 2.

The tunnel 106 also includes a bottom wall 156 which comprises a rectangular tube with 15 a plurality of air pockets. The side walls 148 and the arched tubes 140, 142 and 144 are erected from and fused to the top surface and along the length of the bottom wall 156. In particular, the bottom ends of the side walls 148 and the arched tubes 140, 142 and 144 are fused together with the bottom wall 156 to complete the dome portion of the tunnel 106 as shown in FIGS. 2, 3 and 4. The bottom wall 156 is also preferably made with the same material as the side walls 148.

The tunnel 106 includes a first opening 150 and a second opening 152 for allowing children to crawl there through as is shown in FIG. 2. In particular, the openings 150 and 152 are defined by the arched tubes 140 and 144 and the bottom wall 156. The diameter of the first and second openings 150 and 152 is sized to substantially cover the front child access openings 118 and 130 of the first and second inflatable houses 102 and 104, respectively.

As shown in FIG. 3, the inflatable tunnel 106 includes first and second flaps 180 and 186 extending from the opposite ends of the bottom wall 156 for connecting with the first and second inflatable houses 102 and 104. Each one of the first and second flaps 180 and 186 has a plurality of hook and loop fasteners which are aligned with the hook and loop fasteners placed on the flaps of the inflatable houses 102 and 104.

FIG. 3 illustrates a left elevational view of the interconnecting inflatable play structure of FIG. 2. FIG. 3 shows the side child access openings 116 and 128 of the first and second inflatable houses 102 and 104. The front flaps 166 and 176 and the front access openings 118 and 130 of the first and second houses 102 and 104 are hidden from view as they are blocked by the supports 114 and 120. The first and second flaps 180 and 186 of the tunnel 106 are extended from the opposite ends of the bottom wall 156.

FIG. 4 illustrates a right elevational view of the interconnecting inflatable play structure 100 of FIG. 2. The side walls of the play house 102 and 104 shown in FIG. 4 do not have any openings and are solidly blocked. As shown in this particular arrangement, the two inflatable houses 102 and 104 and the inflatable tunnel 106 are linearly positioned to allow children to travel from the first house 102 to the second house 104. The first and second flaps 180 and 186 of the inflatable tunnel 106 are aligned with the front or side flaps 166 and 176 of the play houses 102 and 104 for easy connection and disconnection by children as shown in FIG. 5.

FIG. 5 illustrates a bottom planar view of the interconnecting inflatable play structure 100 of FIG. 2. As shown, the first and second flaps 180 and 186 extending from the bottom wall 156 of the inflatable tunnel 106 are overlapped with the front flaps 166, 176 of the first and second houses 102 and 104. The pair of hook and loop fasteners 164 of the front flap 166 are aligned with the hook and loop fasteners 182 of the first flap 180. Similarly, the pair of hook and loop fasteners 174 of the front flap 176 are aligned with the hook and loop fasteners 184 of the second flap 186.

Figure 7:
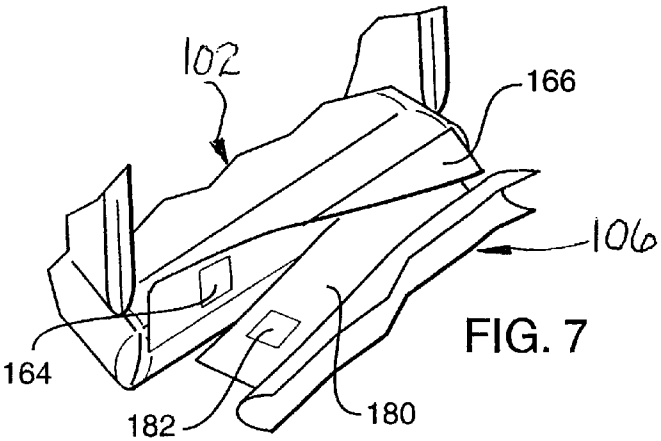
FIG. 7 illustrates a detail view showing the connection between the inflatable tunnel and a play house.
Figure 6:
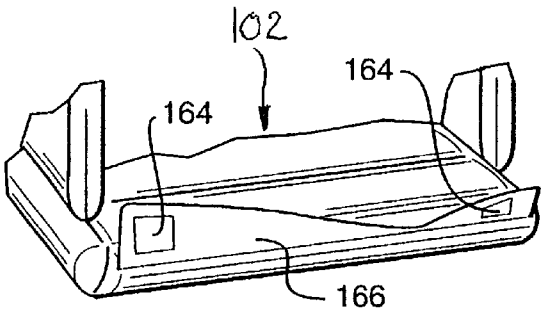
FIG. 6 illustrates a detail view of a flap extending from the inflatable tunnel having a plurality of hook and look fasteners affixed thereon.

FIG. 6 illustrates a detail view of a flap 166 extending from the first inflatable house 102 having a pair of hook and look fasteners 164 affixed thereon. FIG. 7 illustrates a detail view showing the connection between the inflatable tunnel 106 and the first inflatable house 102. In the preferred embodiment of the present invention, the hook and loop fasteners 164, 174 are placed on an under surface of the front flaps 166, 176 of the first and second houses 102 and 104, respectively. However, the first and second flaps 180 and 186 extending from the inflatable tunnel 106 have the hook and loop fasteners 182, 184 on the upper surface to interlockingly overlap the corresponding opposite flaps 166, 176, as shown in FIG. 7. As a result, the flaps may be tilted at any angle to allow, for example, the tunnel 106 to be at an angle with respect to the first inflatable house 102 to allow the children to use the tunnel 106 as a slide.

Moreover, because hook and loop fasteners, by their design, collect and hold loose hairs, dirt, threads, etc., the use of the uninflated overlapping flaps 166, 176, 180 and 186 prevent foreign objects from being tangled with the hook and loop fasteners 164, 174, 182 and 184. In addition, unlike the hook and loop fasteners which are directly attached to an inflated structure, the hook and loop fasteners of the preferred embodiment of the present invention will not tear off from the flaps because the flaps are not inflated.

Figure 8:
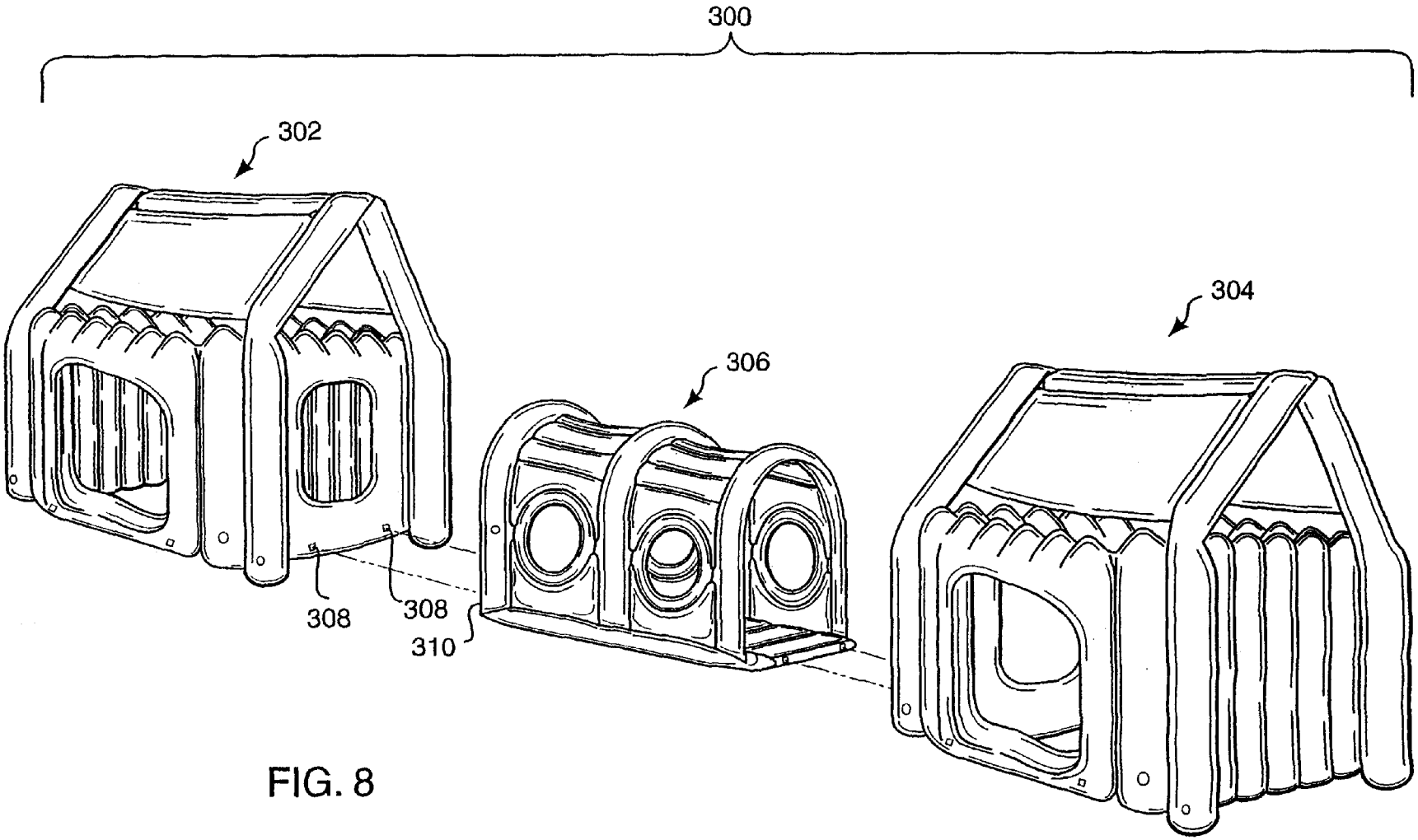
FIG. 8 illustrates a detached view of the interconnecting inflatable play structure according to another embodiment of the present invention.

FIG. 8 illustrates a detached view of the interconnecting inflatable play structure 300 according to a second embodiment of the present invention. The second embodiment has substantially identical first and second inflatable play houses 302 and 304 and an inflatable tunnel 306. However, in lieu of having front and side flaps in the inflatable play houses 302, 304 and first and second flaps in the inflatable tunnel 306, a plurality of hook and loop fasteners 308 are directly affixed to the side of the bottom tubes of each structure. The hook and loop fasteners are positioned so that each respective piece of play structure (i.e., first and second inflatable play houses 302, 304 and inflatable tunnel 306) must to pushed against, i.e., make contact with, each other for achieve attachment. In particular, the hook and loop fasteners 308 of the first inflatable house 302 are aligned with and connected to the hook and loop fasteners 310 of the inflatable tunnel 306 as is illustrated in FIG. 8.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An inflatable play structure for use by a child, the play structure comprising:

an inflatable first structure defining a cavity, the first structure having at least one side wall defining a first access opening, the side wall of the first structure having at least one first flap extending from a lower portion of the side wall, wherein the first flap has at least one hook and loop fastener thereon; and an inflatable second structure having at least one open window and at least one second flap extending therefrom, the second flap having at least one hook and loop fastener thereon which is aligned with the hook and loop fastener of the first flap to releasably couple the first and second structures to allow movement from the first structure to the second structure.

2. The inflatable play structure of claim 1, wherein the first structure is an inflatable house.

3. The inflatable play structure of claim 1, wherein the second structure is an inflatable tunnel.

4. The inflatable play structure of claim 2, wherein the house includes two side walls and front and rear walls which are connected together to form a continuous wall and support tubes placed at each corner of the two side walls and front and rear walls.

5. The inflatable play structure of claim 4, wherein the side wall of the house defining the first opening has the first flap extending therefrom, the first flap containing a pair of hook and loop fasteners aligned with corresponding hook and loop fasteners of the second structure.

6. The inflatable play structure of claim 3, wherein the tunnel includes at least two arched tubes erected from and affixed to a bottom wall, a first arched tube defining a first opening and a second arched tube defining a second opening.

7. The inflatable play structure of claim 6, wherein the tunnel includes the second flap extending from and substantially along the width of the bottom wall.

8. The inflatable play structure of claim 7, wherein the second flap of the tunnel includes a pair of hook and loop fasteners aligned with corresponding hook and loop fasteners of the first structure.

9. The inflatable play structure of claim 1, wherein the first structure is comprised of polyvinylchloride sheeting.

10. The inflatable play structure of claim 1, wherein the second structure is comprised of polyvinylchloride sheeting.

11. The inflatable play structure of claim 2, wherein the second structure is an inflatable tunnel.

12. The inflatable play structure of claim 11, wherein the house includes two side walls and front and rear walls which are connected together to form a continuous wall and support tubes placed at each corner of the two side walls and front and rear walls and the side wall of the house defining the first access opening has the first flap extending therefrom, the first flap containing a pair of hook and loop fasteners aligned with corresponding hook and loop fasteners of the second structure.

13. The inflatable play structure of claim 12, wherein the tunnel includes at least two arched tubes erected from and affixed to a bottom wall, a first arched tube defining a first opening and a second arched tube defining a second opening, and further includes the second flap extending from and substantially along the width of the bottom wall.

14. The inflatable play structure of claim 13, wherein the second flap of the tunnel includes a pair of hook and loop fasteners aligned with corresponding hook and loop fasteners of the first structure.

15. An inflatable play structure for use by a child, the play structure comprising:

an inflatable first structure defining a cavity, the first structure having at least one side wall defining a first access opening;

an inflatable second structure defining a cavity and having at least one open window; and connecting means on exposed outside surfaces of the first and second structures for releasably attaching the first and second structures, wherein the connecting means is attached to an uninflated portion of the first and second structures.

16. The inflatable play structure of claim 15, wherein the connecting means includes at least one first flap extending from a lower portion of the side wall of the first structure, wherein the first flap has at least one hook and loop fastener thereon and at least one second flap extending from the second structure, the second flap having at least one hook and loop fastener thereon which is aligned with the hook and loop fastener of the first flap to releasably couple the first and second structures to allow movement from the first structure to the second structure.

17. The inflatable play structure of claim 15, wherein the first structure is an inflatable house.

18. The inflatable play structure of claim 15, wherein the second structure is an inflatable tunnel.

19. The inflatable play structure of claim 17, wherein the house includes two side walls and front and rear walls which are connected together to form a continuous wall and support tubes placed at each corner of the two side walls and front and rear walls.

20. The inflatable play structure of claim 19, wherein the side wall of the house defining the first access opening includes at least one first flap extending therefrom, the flap containing a pair of hook and loop fasteners aligned with corresponding hook and loop fasteners of the second structure.

21. The inflatable play structure of claim 18, wherein the tunnel includes at least two arched tubes erected from and affixed to a bottom wall, a first arched tube defining a first opening and a second arched tube defining a second opening and further includes at least one second flap extending substantially along the width of the bottom wall.

22. The inflatable play structure of claim 21, wherein the second flap of the tunnel includes a pair of hook and loop fasteners aligned with corresponding hook and loop fasteners of the first structure.

23. An inflatable play structure for use by a child, the play structure comprising:

a first inflatable house defining a cavity, the first house including two side walls and front and rear walls which are connected together to form a continuous wall and support tubes placed at each corner of the two side walls and front and rear walls, one of the walls having a first access opening and at least a first flap extending from a lower portion of the wall, wherein the first flap has a pair of hook and loop fasteners thereon;

a second inflatable house defining a cavity, the second house including two side walls and front and rear walls which are connected together to form a continuous wall and support tubes placed at each corner of the two side walls and front and rear walls, one of the walls having a second access opening and at least a second flap extending from a lower portion of the wall, wherein the second flap has a pair of hook and loop fasteners thereon; and an inflatable tunnel disposed between the first and second houses and having at least one open window and at least two arched tubes erected from and affixed to a bottom wall, a first arched tube defining a first opening and a second arched tube defining a second opening, wherein the tunnel includes a first flap extending substantially along the width of the bottom wall defining the first access opening and a second flap extending substantially along the width of the bottom wall defining the second access opening, the flaps having a pair of hook and loop fasteners aligned with corresponding hook and loop fasteners of the first and second houses to releasably couple the first and second houses and the tunnel, wherein the first and second houses and the tunnel are comprised of polyvinylchloride sheeting.

24. An inflatable play structure for use by a child, the play structure comprising:

An inflatable house defining a cavity, the house including two side walls and front and rear walls which are connected together to form a continuous wall and support tubes placed at each corner of the two side walls and front and rear walls, one of the walls having a first access opening and a plurality of hook and loop fasteners at a lower end of the first access opening; and an inflatable tunnel having at least one open window and at least two arched tubes erected from and affixed to a bottom wall, a first arched tube defining a first opening and a second arched tube defining a second opening, wherein one end of the bottom wall has a plurality of hook and loop fasteners aligned with corresponding hook and loop fasteners of the house to releasably couple the house and the tunnel, wherein the house and the tunnel are comprised of polyvinylchloride sheeting.

* * * * *